US006772518B2

(12) United States Patent
Demuth et al.

(10) Patent No.: US 6,772,518 B2
(45) Date of Patent: Aug. 10, 2004

(54) METHOD OF FORMING FLAT-TUBE INSERTION SLOTS IN A HEADER TUBE

(75) Inventors: Walter Demuth, Gerlingen (DE); Wolfgang Geiger, Ludwigsburg (DE); Martin Kotsch, Ludwigsburg (DE); Hans-Joachim Krauss, Stuttgart (DE); Hagen Mittelstrass, Bondorf (DE); Harald Raiser, Ballingen (DE); Michael Sickelmann, Stuttgart (DE); Karl-Heinz Staffa, Stuttgart (DE); Christoph Walter, Stuttgart (DE)

(73) Assignee: Behr GmbH & Co., Stuttgart (DE)

( * ) Notice: Subject to any disclaimer, the term of this patent is extended or adjusted under 35 U.S.C. 154(b) by 0 days.

(21) Appl. No.: 10/051,374

(22) Filed: Jan. 22, 2002

(65) Prior Publication Data

US 2002/0095789 A1 Jul. 25, 2002

(30) Foreign Application Priority Data

Jan. 22, 2001 (DE) ..... 101 03 176

(51) Int. Cl.[7] ..... B21D 51/38; B23P 15/26

(52) U.S. Cl. ..... 29/890.052; 29/558; 29/890.053; 29/890.043; 165/173; 72/370.27

(58) Field of Search ..... 29/890.052, 557, 29/558, 890.043, 890.054, 890.053, 890.03, 890.148, 890.08; 165/173; 72/370.27, 335, 324, 341

(56) References Cited

U.S. PATENT DOCUMENTS

| | | | | | |
|---|---|---|---|---|---|
| 1,906,953 | A | * | 5/1933 | Enghauser | 29/890.08 |
| 3,689,972 | A | | 9/1972 | Mosier et al. | 29/157.3 |
| 4,503,693 | A | * | 3/1985 | Larikka | 72/71 |
| 4,615,385 | A | * | 10/1986 | Saperstein et al. | 165/175 |
| 4,945,635 | A | | 8/1990 | Nobusue et al. | 29/890.043 |
| 5,243,842 | A | * | 9/1993 | Kobayashi et al. | 29/890.053 |
| 5,329,995 | A | | 7/1994 | Dey et al. | 165/153 |
| 5,421,086 | A | | 6/1995 | Le Gauyer | 29/890.053 |
| 5,737,952 | A | * | 4/1998 | Baumann et al. | 72/55 |
| 5,743,329 | A | | 4/1998 | Damsohn et al. | 165/174 |
| 5,898,996 | A | * | 5/1999 | Buchanan et al. | 29/890.052 |
| 6,098,441 | A | * | 8/2000 | Hada et al. | 72/370.27 |
| 2002/0029474 | A1 | * | 3/2002 | Mitsukawa et al. | 29/890.03 |

FOREIGN PATENT DOCUMENTS

| | | | | |
|---|---|---|---|---|
| DE | 689 07 282 | | 9/1993 | |
| DE | 44 42 040 | | 5/1996 | |
| DE | 693 06 065 | | 4/1997 | |
| DE | 197 41 856 | | 3/1999 | |
| DE | 199 11 334 | | 9/2000 | |
| JP | 355122627 | A * | 9/1980 | 29/890.148 |
| WO | 98/51983 | | 11/1998 | |

* cited by examiner

*Primary Examiner*—Peter Vo
*Assistant Examiner*—Marc Jimenez
(74) *Attorney, Agent, or Firm*—Foley & Lardner LLP

(57) ABSTRACT

The invention relates to a method for forming at least one flat-tube insertion slot in a header tube. A sawcut is introduced into the header tube during a sawing step, and the slot is configured, during a subsequent punching step, by means of a slot punch, which punches into the region of the sawcut. A rimmed opening can be configured during the punching step by using a slot punch with a larger width and/or length relative to the sawcut. The sawcut is preferably introduced to a depth less that the wall thickness of the header tube. The respective web region(s) between chamber of a multi-chamber header tube can be compressed during the punching operation to a level lower than that of a header-tube wall region functioning as a flat-tube insertion stop, in order to form a chamber-connecting duct.

16 Claims, 2 Drawing Sheets

METHOD OF FORMING FLAT-TUBE INSERTION SLOTS IN A HEADER TUBE

CROSS-REFERENCE TO RELATED PATENT APPLICATIONS

The right of priority under 35 U.S.C. §119(a) is claimed based on German Patent Application No. 101 03 176.9, filed Jan. 22, 2001, the entire disclosure of which is hereby incorporated by reference.

BACKGROUND OF THE INVENTION

The present invention relates to a method for introducing at least one flat-tube insertion slot into a header tube for a heat exchanger. In a first step of the method, a sawcut is made into the header tube for the respective flat-tube insertion slot and, during a subsequent second step, the flat-tube insertion slot is configured by means of a slot punch. The slot punch punches into the region of the sawcut. Such a method is, for example, suitable for introducing one or a plurality of flat-tube insertion slots into header tubes of an air-conditioning system heat exchanger, of the type employed in motor vehicles as evaporators or condensers and/or gas coolers.

In a method of this type that is described in the DE 44 42 040 A2, the sawcut is carried out as a sawn slot to a depth which is, on the one hand, greater than the tube wall thickness and, on the other hand, less than the tube radius of the header tube. As a result, at the level of the sawcut, the header tube has a circular cross-sectional shape extending above a semi-circular shape at the opening. During a subsequent punching step, the short side regions of the header-tube wall section bounding the sawcut are then enlarged and calibrated to the final slot length by means of a slot punch. In this procedure, provision is made for the length of the sawcut introduced transverse to the header-tube longitudinal axis to be selected to be at least smaller than the header-tube inner diameter by twice the wall thickness of the header tube, so that during the punching step, the end region of the slot walls is pressed outwardly to beyond the outer envelope of the header tube, and the slot length is larger than the header-tube inner diameter.

WO 98/51983 A1 also discloses a method for producing flat-tube insertion slots in a multi-chamber header tube. This method includes two sequential sawing steps. During a first step, a sawn slot is made over the whole of the desired insertion slot width and, in fact, deeper than the wall thickness of the header tube. Thus, the slot reaches the individual chambers or longitudinal ducts of the header tube but does not reach as far as the longitudinal central plane of the header tube. During the second sawing step, the sawn slot made during the first sawing step is then deepened over a smaller width so that shoulders or steps are formed in the web regions which separate the individual chambers. These shoulders or steps serve as stop surfaces for the flat tube to be inserted, with the result that connecting ducts between the chambers remain when the flat tube is inserted. The slot length is selected to be somewhat less than the effective inner header-tube width, i.e., less than the outer width of the header tube less twice the tube wall thickness.

SUMMARY OF THE INVENTION

It is the principal object of the invention to provide a novel method for producing one or a plurality of flat-tube insertion slots in a header tube, with advantageous slot contour and/or in an advantageous manner.

In accordance with one aspect of the present invention, there has been provided a method for forming at least one flat-tube insertion slot in a heat exchanger header tube suitable for use in an air-conditioning system, comprising: making a sawcut in the header tube, the sawcut having a first length and a first width; and configuring the flat-tube insertion slot by punching into the region of the sawcut with a slot punch, the slot punch having at least one of a larger width and larger length relative to the respective first width and first length of the sawcut, to thereby form a rimmed opening having a rim on at least a portion of its periphery extending into the interior of the header tube.

In accordance with another aspect of the invention, there is provided a method for forming at least one flat-tube insertion slot in a heat exchanger header tube suitable for use in an air-conditioning system, comprising: making a sawcut in the header tube wherein the sawcut is introduced to a depth ($d_1$) which is less than the wall thickness (D) of the header tube; and configuring the flat-tube insertion slot by punching into the region of the sawcut with a slot punch.

In accordance with still another aspect of the invention, there is provided a method for forming at least one flat-tube insertion slot in a heat exchanger header tube suitable for use in an air-conditioning system, comprising: making a sawcut in the header tube; and configuring the flat-tube insertion slot by punching into the region of the sawcut with a slot punch, wherein the header tube comprises a multi-chamber header tube having a plurality of adjacent tube passageways separated at a distance from one another by means of respective web region(s), and the flat-tube insertion slot extends transversely over a plurality of the tube passageways, and wherein during the punching, at least a portion of the respective web region(s) is compressed to a level lower than a flat-tube insertion stop, whereby a space connecting at least two of the passageways will be defined upon insertion of a flat tube.

Further objects, features and advantages of the present invention will become apparent from the detailed description of preferred embodiments that follows, when considered together with the accompanying figures of drawing.

DETAILED DESCRIPTION OF PREFERRED EMBODIMENTS OF THE INVENTION

In the method of the invention, provision is especially made for the flat-tube insertion slot to be configured as a so-called rimmed opening, i.e., with a slot border bent over parallel to the flat-tube insertion direction. This provides the inserted flat tube with additional support and facilitates the fluid-tight connection of the latter to the header tube. The rimmed opening is configured in a simple manner by providing that the slot punch used during the punching step has a larger width and/or length than the sawcut previously made during the sawing step.

In the method according to one preferred embodiment, the sawcut during the first step is introduced only to a depth which is less than the material of the wall, i.e., the wall thickness, of the header tube. This avoids "sawdust" (cuttings) from penetrating as disturbing impurities into the header tube during the sawing step.

According to another preferred embodiment, the method is especially suitable for multi-chamber header tubes and is configured in such a way that, during punching, the respective web region of the header tube that separates two adjacent header-tube chambers from one another is compressed to a level lower than that of a header-tube wall region functioning as a flat-tube insertion stop. In this way, the compressed web portion forms a chamber-connecting duct.

There are various possibilities for achieving the flat-tube insertion stop. As an example, in one embodiment of the invention, stop surfaces are formed by the inner wall region of the two outer header-tube chambers. This inner wall region can, for example, involve a chamber wall region to the rear in the flat-tube insertion direction or, as is provided in another embodiment of the invention, it can involve a shoulder that is configured during punching on the inside of the two outer header-tube wall regions on the short sides. In a further embodiment of the invention, the flat-tube insertion stop includes one or a plurality of protrusions that are configured in a respective web region between two chambers during the punching operation.

Certain advantageous embodiments of the invention are described below with reference to the drawings.

The figures illustrate examples processes for producing a respective flat-tube insertion slot into a single-chamber or multi-chamber header tube. The header tube is comparatively thick-walled and is therefore suitable for use in heat exchangers subjected to high pressure loading, for example, evaporators and gas coolers of a $CO_2$ air-conditioning system, as are increasingly employed in motor vehicles.

Figure 1:
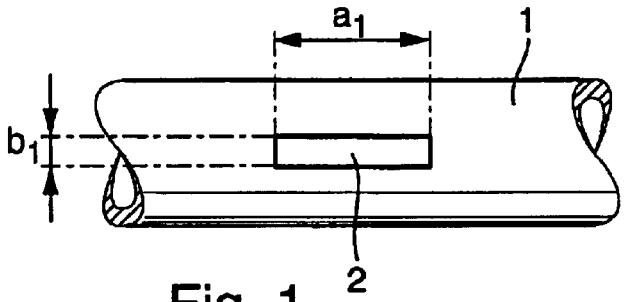
FIGS. 1 and 2 are a plan view and a longitudinal sectional view of a header-tube region having a sawcut made in the tube longitudinal direction.
Figure 2:
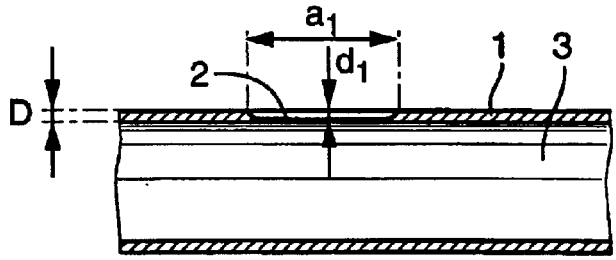

FIGS. 1 to 4 illustrate the introduction of a respective longitudinal slot 2 into a single-chamber header tube 1. Into this slot, for example, a heat-exchanger flat-tube end, twisted by 90°, is inserted in a known manner and can be connected in a fluid-tight manner to the header tube. The introduction of the longitudinal slot or slots takes place by a two-step method. As represented in FIGS. 1 and 2, a sawcut 2 with a length $a_1$ and a width $b_1$ is first sawn into the header tube 1 at the desired location. The sawcut 2 is introduced to a depth $d_1$, which is smaller than the wall thickness D of the header tube 1. This avoids any sawdust penetrating to the inside 3 of the header tube 1 during this sawing step. As an alternative, the sawcut can also be introduced to a depth greater than the header-tube wall thickness D, i.e., the sawcut generated during this first method step then forms a sawn slot which penetrates the header-tube wall. In this case, any sawdust occurring can, if required, be removed during a corresponding cleaning step.

Figure 3:
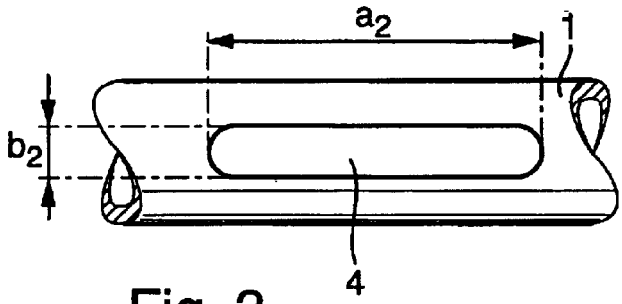
FIGS. 3 and 4 are a plan view and a longitudinal sectional view of the header-tube section of FIGS. 1 and 2 after completion of the flat-tube insertion slot with rimmed opening, by means of punching with a slot punch.
Figure 4:
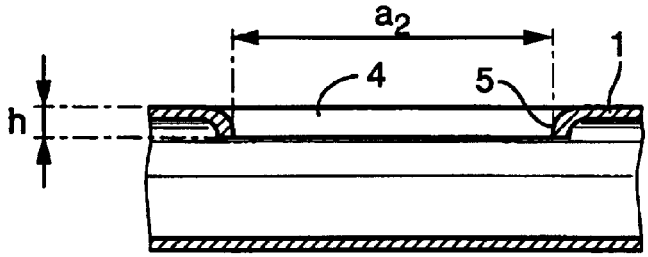

During a subsequent second method step, the desired flat-tube insertion slot is generated radially from the outside of the header into the region of the sawcut 2 by punching with a slot punch (not shown). FIGS. 3 and 4 illustrate the flat-tube insertion slot 4 formed in this manner. The slot punch used, and in consequence, the flat-tube insertion slot 4 punched by it, have, in this preferred instance, a length $a_2$ greater than the sawcut length $a_1$ and a width $b_2$ greater than the sawcut width $b_1$. This means that the header-tube wall section bordering the sawcut 2 is bent radially inwardly during the punching operation and, in this way, forms a rimmed opening 5 directed radially inwardly. In the example shown in FIGS. 3 and 4, the excess length $a_2-a_1$ and the excess width $b_2-b_1$ of the slot punch are selected, relative to the sawcut 2, in such a way that there is a constant height h of the rimmed opening 5 along the whole of the flat-tube insertion slot 4.

Figure 5:
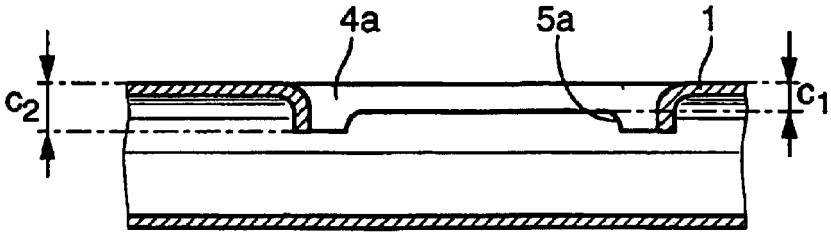
FIG. 5 is a longitudinal sectional view corresponding to FIG. 4, for a method variant having locally varying heights of the rimmed opening.

FIG. 5 shows a method variant in which the excess length dimension and the excess width dimension of the slot punch are selected, relative to the previously introduced sawcut, in such a way that there is a larger rimmed-opening height $c_2$ in the region of the short sides of a flat-tube insertion slot 4*a* with rimmed opening 5*a* formed by the slot punch. In the slot region on the long sides, there is a rimmed-opening height $c_1$ which is relatively smaller. This illustrates the fact that the shape and height of the rimmed opening formed during the punching step can be specified in a desired manner by the dimensional relationships between the slot punch and the sawcut, which is in turn determined by the sawcut length and the diameter and the width of a saw blade used in the sawing step. In addition, the rimmed-opening height and a flat-tube entry bevel, which is preferably formed by means of corresponding shaping of the rimmed opening, can be influenced by material properties, for example, by the hardness of the header-tube material used. The entry bevel transverse to the tube extent can be influenced by the flank angle of the slot punch. The width and length of the sawcut determine the so-called header-tube blockage due to the rimmed opening formed and/or the flat tube inserted.

It is found that preferred dimensional relationships for rimmed-opening formation include a ratio of sawcut length $a_1$ to slot punch length $a_2$ of between approximately 0.2 and approximately 0.95, and a ratio of sawcut width $b_1$ to slot punch width $b_2$ of between approximately 0.3 and approximately 0.95.

If a plurality of flat-tube insertion slots are to be introduced into the header tube, provision is preferably made during the sawing step for all the associated sawcuts to be sawn in one operation and, during the subsequent punching step, for all the flat-tube insertion slots to be configured by punching in a further single operation.

As an alternative to using a slot punch with both a larger width and length relative to the sawcut, a slot punch can be used with arbitrarily different dimensions, in particular even a slot punch that only has a larger length but not a larger width, or one which only has a larger width but not a larger length. In this way, a rimmed opening appears only in the slot region on the short sides or the long sides.

Figure 6:
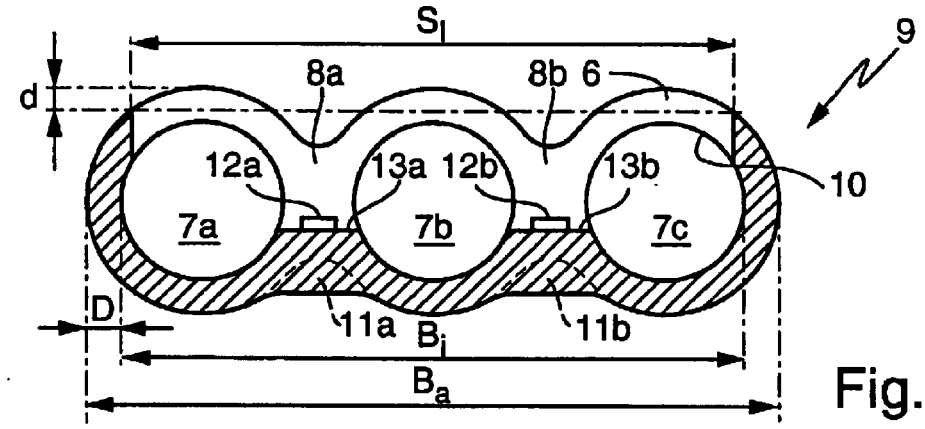
FIG. 6 is a transverse sectional view of a three-chamber header tube with flat-tube insertion slot and with tube insertion stops in the web regions separating the chambers.

FIG. 6 illustrates, in a transverse sectional view, the introduction of a flat-tube insertion slot 6 into a three-chamber header tube 9 which has three longitudinally extending passageways or ducts 7*a*, 7*b*, 7*c*, which are arranged parallel to one another and are separated from one another by a respective web region 8*a*, 8*b*. The flat-tube insertion slot 6 extends transversely across the three longitudinal ducts 7*a*, 7*b*, 7*c* in a length $S_1$, which corresponds approximately to the effective inner width $B_i=B_a-2D$ of the header tube 9, determined by the difference of the header-tube outer width $B_a$ minus twice the tube wall thickness D.

In order to manufacture this flat-tube insertion slot 6, a sawcut of the desired slot length $S_l$ is first introduced to a depth d which, in turn, is preferably somewhat smaller than the tube wall thickness D, so that no sawdust penetrates into the header-tube ducts 7*a*, 7*b*, 7*c*. The flat-tube insertion slot 6 is subsequently generated in the shape given in FIG. 6 by punching, in the region of the sawcut, with a suitably designed slot punch. The slot punch preferably has a somewhat larger width relative to the sawcut, so that a rimmed opening 10 pointing inwardly appears in the slot region on the long sides. At locations corresponding to the web regions 8*a*, 8*b*, the slot punch is designed in such a way that, when punching, it compresses the web regions 8*a*, 8*b*. In the process, corresponding bulges 11*a*, 11*b* form on the opposite header-tube side, and protrusions 12*a*, 12*b* form on the compressed web surface 13*a*, 13*b*. These protrusions 12*a*, 12*b* function as a stop surface for the flat tube to be inserted.

As a result, the flat tube can be inserted into the slot 6 as far as the level of the protrusions 12*a*, 12*b*. When the flat tube is inserted, therefore, respective connecting ducts remain, which are laterally adjacent to the protrusions 12*a*, 12*b* between the end surface of the flat tube and the compressed bottom surface 13*a*, 13*b* of the web region. Consequently, the three chambers 7*a*, 7*b*, 7*c* are brought into fluid connection with one another by means of these connecting ducts. In this way, a fluid can be supplied to (or removed from) the plurality of ducts of one or a plurality of multi-duct flat tubes inserted into the header tube 9, i.e., in parallel via the plurality of header-tube ducts 7*a*, 7*b*, 7*c*,.

Figure 7:
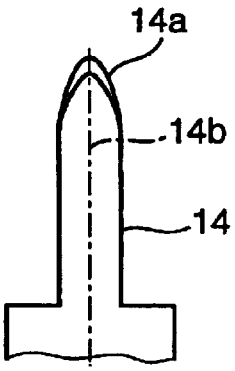
FIGS. 7 and 8 are side views of a slot punch which can be used for the punching step during the introduction of the flat-tube insertion slot as shown in FIG. 6.
Figure 8:
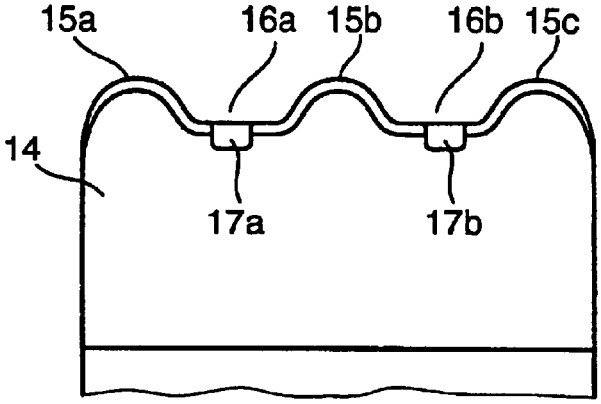

FIGS. 7 and 8 show a slot punch 14 that can be used during the punching step to form the flat-tube insertion slot 6 of FIG. 6. In FIG. 7, the slot punch 14 is shown in a side view from a short side and, in FIG. 8, in an end view onto a long side. As may be seen from these views, the effective front surface 14*a* of the slot punch 14 is suitably designed in a special manner. It tapers to a sharp edge from the long sides toward the punch central plane 14*b*. In the longitudinal direction, it respectively extends in the shape of a circular segment in the regions 15*a*, 15*b*, 15*c* corresponding to the three header-tube chambers 7*a*, 7*b*, 7*c*, whereas, in the two intermediate regions 16*a*, 16*b* that correspond to the header-tube web regions 8*a*, 8*b*, it is respectively provided with recesses 17*a*, 17*b*, which are responsible for forming the protrusions 12*a*, 12*b*.

Figure 9:
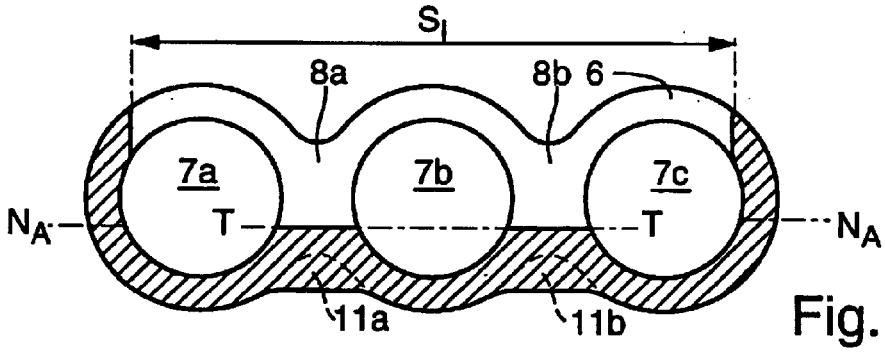
FIG. 9 is a view corresponding to FIG. 6, showing a variant in which a rear chamber wall region functions as a flat-tube insertion stop.

FIG. 9 illustrates a variant of the exemplary embodiment of FIG. 6. In this alternate embodiment, connecting ducts are again created between the header-tube ducts 7*a*, 7*b*, 7*c* in the punching operation by the compression of the web regions 8*a*, 8*b*, but without the protrusions 12*a*, 12*b* in the compressed web regions 8*a*, 8*b* of the example of FIG. 6 being necessary to prevent complete closure of these connecting ducts by the inserted flat tube in this case. In the exemplary embodiment of FIG. 9, complete closure is prevented by matching the length $S_l$ of the insertion slot 6, which essentially corresponds to the width of the flat tube, and the level T, to which the web regions 8*a*, 8*b* are compressed. These are matched to one another in such a way that the inserted flat tube comes into contact with the rear inner wall half of the two outer header-tube ducts 7*a*, 7*c* at a stop level $N_A$, which is located—in the insertion direction—before the level T of the compressed web regions 8*a*, 8*b*. Connecting ducts therefore remain between the three header-tube chambers 7*a*, 7*b*, 7*c* in the web regions 8*a*, 8*b* to a height corresponding to the level difference $|T-N_A|$ between the level T of the compressed web regions 8*a*, 8*b* and the level $N_A$ of the inserted flat-tube ends.

Figure 10:
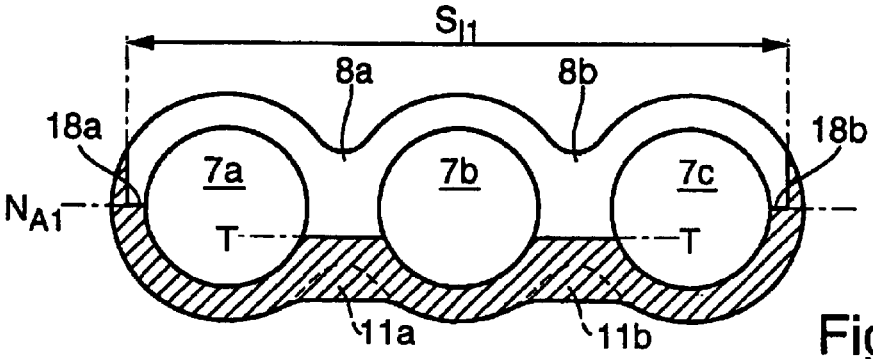
FIG. 10 is a view corresponding to FIG. 6, showing a variant in which shoulders on the inner walls of the outer chambers are configured as a flat-tube insertion stop.

FIG. 10 shows a further variant of the exemplary embodiment of FIG. 6, without the web region protrusions 12*a*, 12*b*. Common reference numerals are used in FIG. 9 for functionally similar elements to facilitate comprehension. In the exemplary embodiment of FIG. 10, a shoulder or a step 18*a*, 18*b* is respectively configured laterally to the outside on the inner walls of the two outer header-tube ducts 7*a*, 7*c*, and in fact at the level of a desired flat-tube insertion level $N_{A1}$. This is accomplished by appropriate design of the slot punch and selection of a suitable slot length $S_{11}$. At the same time, the web regions 8*a*, 8*b* are in turn compressed by the appropriately designed slot punch to a level T, which is located below the flat-tube insertion level $N_{A1}$, in the flat-tube insertion direction. In this way, the flat tube comes to a stop against the two shoulders 18*a*, 18*b* during insertion, so that its end is located, as desired, at the insertion level $N_{A1}$. The connecting ducts between the header-tube chambers 7*a*, 7*b*, 7*c* created by the compression of the web regions 8*a*, 8*b* are maintained at a height $|T-N_{A1}|$, which in turn corresponds to the difference between the level T of the compressed web regions 8*a*, 8*b* and the level $N_{A1}$ of the inserted flat-tube ends.

As is clear from the above description of advantageous exemplary embodiments, the two-step method according to the invention permits an advantageous introduction of longitudinally or transversely extending flat-tube insertion slots into a single-chamber or multi-chamber header tube, especially also in a comparatively thick-walled header tube. This is achieved by introducing a sawcut and then subsequently punching with a slot punch. The geometry of the insertion slot can be selected by means of the shape of the slot punch. Depending on use requirements, inwardly directed rimmed openings can be created during the punching operation for improved, reliably fluid-tight connection between the inserted flat tube and the header tube. In the case of a multi-chamber header tube, connecting ducts between the header-tube chambers can be created. It is obvious that the invention is applicable not only to single-chamber and three-chamber header tubes, as shown, but also to multi-chamber header tubes with two, or more than three, parallel chambers.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

What is claimed is:

1. A method for forming at least one flat-tube insertion slot in a heat exchanger header tube suitable for use in an air-conditioning system, comprising:

making a sawcut in the header tube, the sawcut having a first length and a first width; and configuring the flat-tube insertion slot by punching into the region of the sawcut with a slot punch, the slot punch having at least one of a larger width and larger length relative to the respective first width and first length of the sawcut, to thereby form a rimmed insertion slot having a rim on at least a portion of its periphery extending into the interior of the header tube, wherein the first width, first length and the width and length of the slot punch are selected such that the rim formed on a first portion of the insertion slot is longer than the rim on at least one second portion of the periphery of the insertion slot.

2. A method as claimed in claim 1, wherein the sawcut is introduced to a depth ($d_1$) which is less then the wall thickness (D) of the header tube.

3. A method as claimed in claim 1, wherein the sawcut is made in a direction parallel to the axis of the header tube.

4. A method as claimed in claim 1, wherein the sawcut is made in a direction transverse to the axis of the header tube.

5. A method as claimed in claim 1, wherein the rim is longer in the smaller dimension of the insertion slot.

6. A method as claimed in claim 1, wherein the header tube has a wall having a comparatively thick wall thickness suitable for use in a heat exchanger subjected to high pressure loading at the level used for systems utilizing $CO_2$ as a heat exchange agent.

7. A method as claimed in claim 1, wherein the step of making said sawcut comprises cutting the sawcut with a saw blade having a predetermined diameter and width.

8. A method for forming at least one flat-tube insertion slot in a heat exchanger header tube suitable for use in an air-conditioning system, comprising:

making a sawcut in the header tube; and configuring the flat-tube insertion slot by punching into the region of the sawcut with a slot punch, wherein the header tube comprises a multi-chamber header tube having a plurality of adjacent tube passageways separated at a distance from one another by means of respective web region(s), and the flat-tube insertion slot extends transversely over a plurality of the tube passageways, and wherein during the punching, at least a portion of the respective web region(s) is compressed to a level lower than a flat-tube insertion stop, whereby a space connecting at least two of the passageways will be defined upon insertion of a flat tube.

9. A method as claimed in claim 8, wherein a header-tube wall region forms the flat-tube insertion stop.

10. A method as claimed in claim 8, wherein the flat-tube insertion stop comprises peripheral well surfaces on the distal inner walls of the two outermost header-tube passageways.

11. A method as claimed in claim 8, wherein the flat-tube insertion stop comprises a shoulder-shaped stop surface on each inner wall of the two outermost header-tub passageways, which surfaces are formed during the punching.

12. A method as claimed in the flat-tube insertion stop comprises at least one protrusion which is formed in a web region during the punching.

13. A method for forming at least one flat-tube insertion slot in a heat exchanger header tube suitable for use in an air-conditioning system, comprising:

making a sawcut in the header tube, the sawcut having a first length and a first width; and configuring the flat-tube insertion slot by punching into the region of the sawcut with a slot punch, the slot punch having at least one of a larger width and larger length relative to the respective first width and first length of the sawcut, to thereby form a rimmed insertion slot having a rim on at least a portion of its periphery extending into the interior of the header tube, wherein the sawcut is substantially linear and has a first length $a_1$ and a first width $b_1$ and wherein the slot punch has a larger length $a_2$ and a larger width $b_2$ and at least one of the following is true; the ratio of sawcut length $a_1$ to slot punch length $a_2$ is between approximately 0.2 and approximately 0.95; and the ratio of sawcut width $b_1$ to slot punch width $b_2$ is between approximately 0.3 and approximately 0.95.

14. A method for forming at least one flat-tube insertion slot in a heat exchanger header tube suitable for use in an air-conditioning system, comprising:

making a sawcut in the header tube, wherein the sawcut is introduced to a depth ($d_1$) which is lass than the wall thickness (D) of the header tube; and configuring the flat-tube insertion slot by punching into the region of the sawcut with a slot punch, wherein the sawcut is substantially linear and has a first length $a_1$ and a first width $b_1$, and wherein the slot punch has a larger length $a_2$ and a larger width $b_2$ and at least one of the following is true: the ratio of sawcut length $a_1$ to slot punch length $a_2$ is between approximately 0.2 and approximately 0.9; and the ratio of sawcut width $b_1$ to slot punch width b2 is between approximately 0.3 and approximately 0.95.

15. A method as claimed in claim 14, wherein the header tube has a wall having a comparatively thick wall thickness suitable for use in a heat exchanger subjected to high pressure loading at the level used for systems utilizing $CO_2$ as a heat exchange agent.

16. A method as claimed in claim 14, wherein the step of making said sawcut comprises cutting the sawcut with a saw blade having a predetermined diameter and width.

* * * * *